US008922317B2

(12) United States Patent
Yamada et al.

(10) Patent No.: US 8,922,317 B2
(45) Date of Patent: Dec. 30, 2014

(54) COIL COMPONENT

(71) Applicant: Sumida Corporation, Chuo-ku, Tokyo (JP)

(72) Inventors: Satoru Yamada, Chuo-ku (JP); Kazuyuki Kikuchi, Chuo-ku (JP); Yoshiyuki Tahara, Chuo-ku (JP)

(73) Assignee: Sumida Corporation (JP)

( * ) Notice: Subject to any disclaimer, the term of this patent is extended or adjusted under 35 U.S.C. 154(b) by 0 days.

(21) Appl. No.: 13/693,766

(22) Filed: Dec. 4, 2012

(65) Prior Publication Data

US 2013/0154780 A1 Jun. 20, 2013

(30) Foreign Application Priority Data

Dec. 15, 2011 (JP) ..... 2011-274495

(51) Int. Cl.

| | |
|---|---|
| ***H01F 27/29*** | (2006.01) |
| ***H01F 27/06*** | (2006.01) |
| ***H01F 27/02*** | (2006.01) |
| ***H01F 5/00*** | (2006.01) |
| ***H01F 27/28*** | (2006.01) |
| ***H01F 17/04*** | (2006.01) |

(52) U.S. Cl.

CPC ..... *H01F 27/29* (2013.01); *H01F 17/043* (2013.01); *H01F 27/292* (2013.01)

USPC ..... 336/192; 336/65; 336/83; 336/200; 336/232

(58) Field of Classification Search

USPC ..... 336/65, 83, 192, 200, 232

See application file for complete search history.

(56) References Cited

U.S. PATENT DOCUMENTS

| | | | | |
|---|---|---|---|---|
| 6,292,083 | B1 * | 9/2001 | Tajima et al. | 336/192 |
| 7,986,208 | B2 * | 7/2011 | Yan et al. | 336/192 |
| 2007/0057758 | A1 * | 3/2007 | Sano | 336/212 |
| 2007/0063803 | A1 * | 3/2007 | Yamashita et al. | 336/83 |
| 2009/0315660 | A1 * | 12/2009 | Oki | 336/192 |
| 2011/0260821 | A1 * | 10/2011 | Yamada et al. | 336/192 |
| 2012/0188045 | A1 | 7/2012 | Yamada et al. | |

FOREIGN PATENT DOCUMENTS

| | | |
|---|---|---|
| JP | 07-147205 | 6/1995 |
| JP | 2005-310869 | 11/2005 |

OTHER PUBLICATIONS

Winkelman, Andre, Extended European Search Report for Application No. EP 12 19 7330 mailed May 24, 2013, EPO, Munich, Germany (6 pages).

* cited by examiner

*Primary Examiner* — Tsz Chan

(74) *Attorney, Agent, or Firm* — Harness, Dickey & Pierce, P.L.C.

(57) ABSTRACT

A coil component including: a magnetic core which is formed by a magnetic material and which has a top surface, a bottom surface facing the top surface and a side surface continuous approximately perpendicularly to the top surface and the bottom surface; a coil which is buried inside the magnetic core and whose end portion protrudes from the side surface of the magnetic core; a flat-shaped terminal which protrudes from the side surface of the magnetic core, is bent toward the bottom surface of the magnetic core and is connected with the end portion of the coil, wherein there is formed an opening portion at a position corresponding to the place which is bent for the flat-shaped terminal from the side surface to the bottom surface of the magnetic core.

7 Claims, 6 Drawing Sheets

COIL COMPONENT

CROSS REFERENCE TO RELATED APPLICATION

The present invention contains subject matter related to Japanese Patent Application 2011-274495 filed in the Japanese Patent Office on Dec. 15, 2011, the entire contents of which being incorporated herein by reference.

BACKGROUND OF THE INVENTION

1. Field of the Invention

The present invention relates to a coil component which is used for various kinds of electrical products, electronic equipment or the like.

2. Description of the Related Art

For the coil component in the past, there exists a coil component in which a coil formed by winding a conductive wire is buried inside a magnetic core formed by a magnetic material, such as described, for example, in Patent Document 1 (Japanese unexamined patent publication No. 2005-310869). In this coil component, the coil is buried inside the magnetic core and the lead line of the coil, so called the end portion, protrudes from the side surface of the coil component.

Also, the flat-shaped terminal of this coil component is buried inside the magnetic core for a portion thereof and the remaining portion thereof protrudes from the side surface of the magnetic core similarly as the end portion of the coil. Then, by connecting this terminal and the end portion of the coil in an overlap configuration, the terminal and the coil are made conductive electrically. Also, the terminal is bent approximately by 90 degrees along a ridge line between the side surface and the bottom surface, so called corner, of the magnetic core.

SUMMARY OF THE INVENTION

However, for the coil component described in the Patent Document 1, the terminal thereof is formed approximately in a flat shape. Then, an excessive force was necessary for bending the flat-shaped terminal approximately as much as 90 degree. Therefore, the adjustment of the force to be added to the terminal when bending was difficult and there occurs a situation in which the bending accuracy of the terminal lowered. As a result thereof, in the coil component described in the Patent Document 1, As a result thereof, in the coil component described in the Patent Document 1, there occurred a situation in which the position of the terminal tip after being bent and the external dimensions of the coil component itself fluctuate caused by a fluctuation of the bending angles of the terminal, by a mechanism in which the terminal is not bent along the predetermined curve line, or the like.

Also, since the terminal is bent by setting the corner which connects the side surface and the bottom surface of the magnetic core to be a supporting point, the force occurring when bending the terminal is added to the corner of the magnetic core. As a result thereof, in a case in which the force when bending the terminal is large, there was a fear that the corner of the magnetic core may be damaged by the force when bending the terminal.

Consequently, in view of the problem mentioned above, the present invention is addressed to provide a coil component in which the necessary force when bending the terminal is made small and a high bending accuracy can be secured.

A coil component according to the present invention includes a magnetic core, a coil and a flat-shaped terminal. The magnetic core is formed by a magnetic material, and includes a top surface, a bottom surface facing the top surface and a side surface continuous approximately in perpendicular to the top surface and the bottom surface. The coil is buried inside the magnetic core and the end portion thereof protrudes from the side surface of the magnetic core. The flat-shaped terminal protrudes from the side surface of the magnetic core, is bent toward the bottom surface of the magnetic core and is connected with the end portion of the coil.

Then, there is formed an opening portion in the flat-shaped terminal at a position corresponding to the place where the flat-shaped terminal is bent from the side surface to the bottom surface of the magnetic core.

According to the coil component of the present invention, it is possible to bend the flat-shaped terminal by a small force, so that it is possible to heighten the bending accuracy and it is possible to bend the flat-shaped terminal accurately along the corner between the side surface and the bottom surface of the magnetic core. As a result thereof, it is possible to heighten the bending accuracy of the terminal, so that it is possible to provide a coil component in which the external-dimensional accuracy is preferable.

DESCRIPTION OF THE PREFERRED EMBODIMENTS

Hereinafter, there will be explained the coil component relating to exemplified embodiments of the present invention based on FIGS. 1 to 9, but the present invention is not to be limited by the following examples. The explanation is carried out in the following order.

1. First Exemplified Embodiment
1-1. Constitution of Coil Component
1-2. Manufacturing Method of Coil Component
2. Second Exemplified Embodiment 3. Third Exemplified Embodiment
4. Fourth Exemplified Embodiment
5. Fifth Exemplified Embodiment 1. First Exemplified Embodiment 1-1. Constitution of Coil Component First, by using FIGS. 1 to 4, there will be explained a constitution of a coil component relating to a first exemplified embodiment (hereinafter, referred to as "this embodiment") of the present invention.

Figure 1:
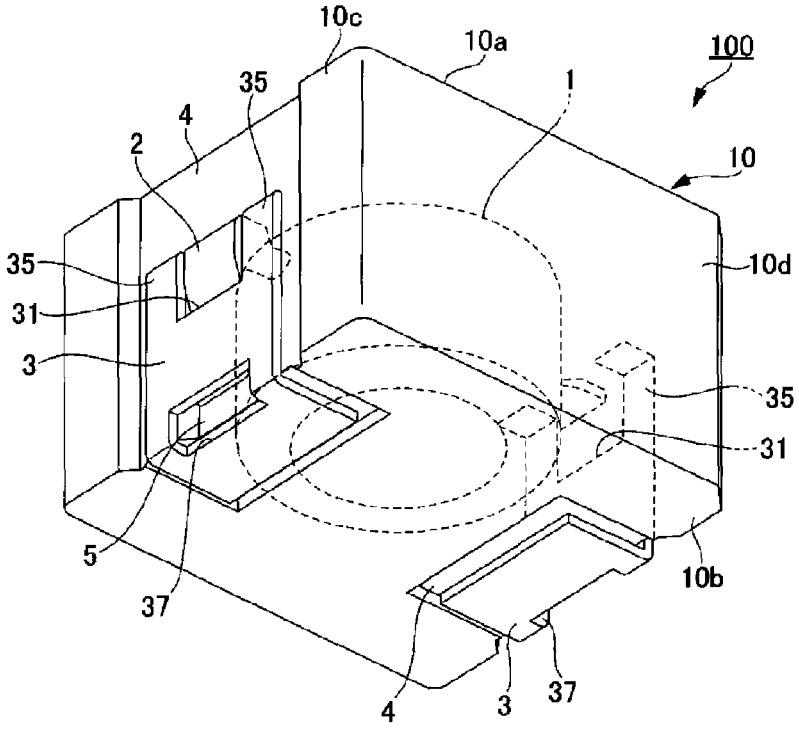
FIG. 1 is a perspective view of a coil component relating to a first exemplified embodiment of the present invention.
Figure 2:
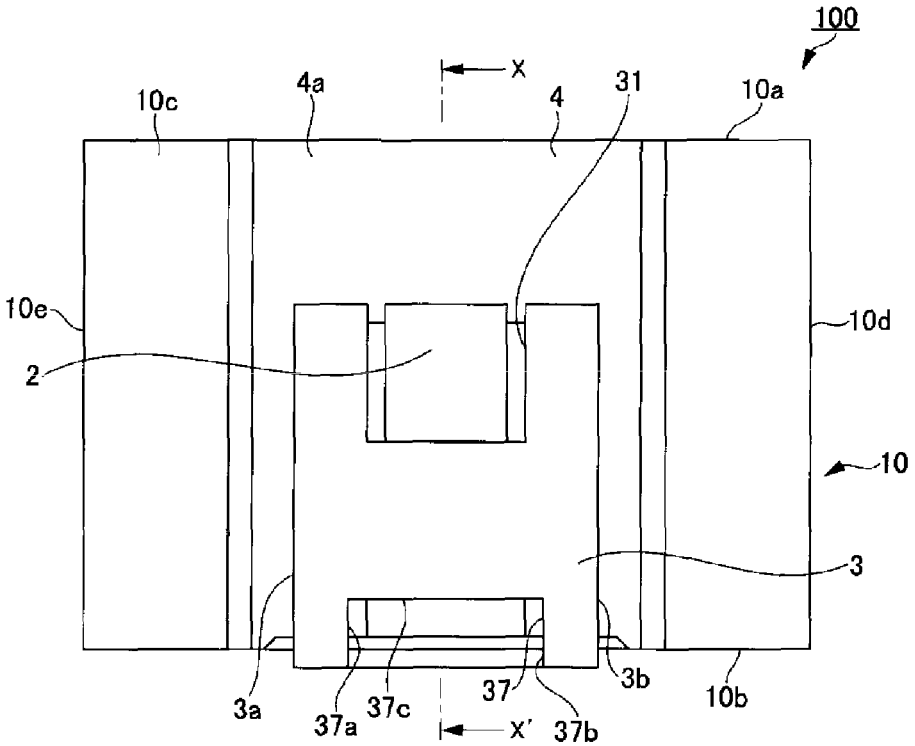
FIG. 2 is a side view of the coil component relating to the first exemplified embodiment of the present invention.
Figure 3:
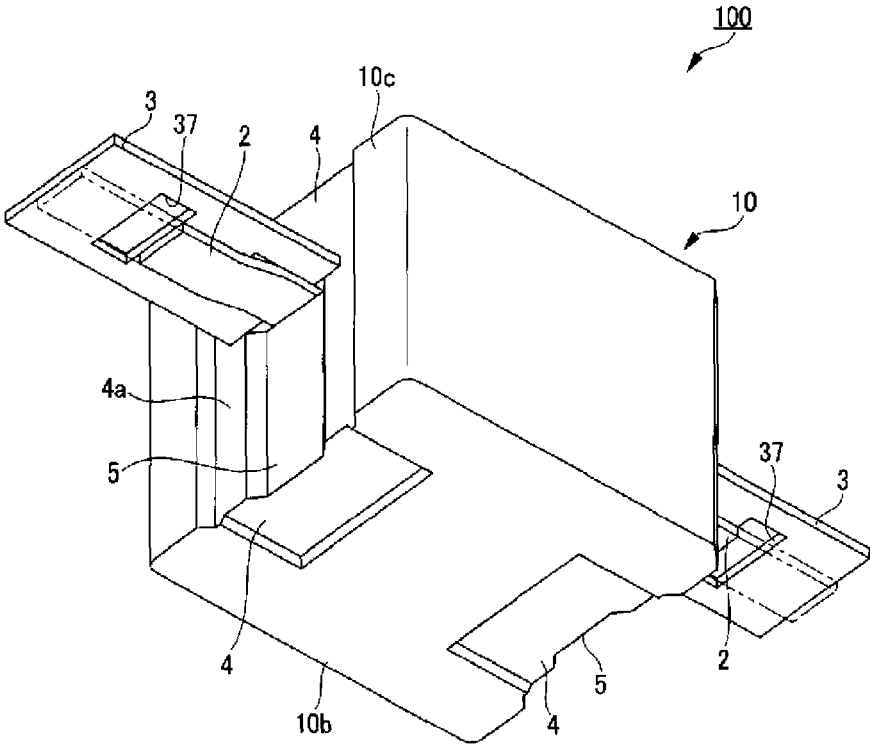
FIG. 3 is a perspective view showing a state before bending a flat-shaped terminal in the coil component relating to the first exemplified embodiment of the present invention.
Figure 4:
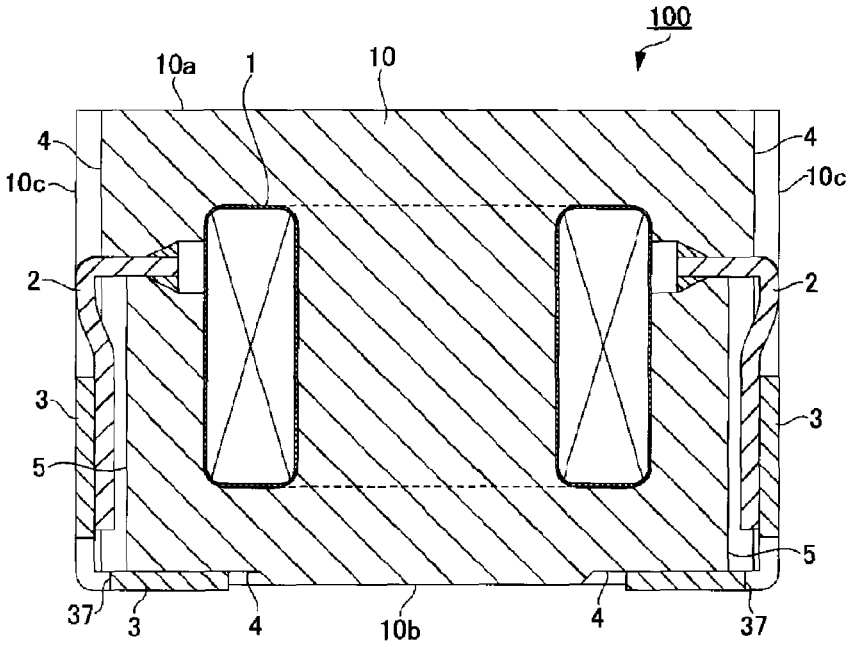
FIG. 4 is a schematic cross-sectional view of the coil component relating to the first exemplified embodiment of the present invention.

FIG. 1 is a perspective view of a coil component of this embodiment. Also, FIG. 2 is a side view of the coil component of this embodiment, and FIG. 3 is a perspective view showing a state before bending a flat-shaped terminal in the coil component. FIG. 4 is a cross-sectional view at an X-X' line in FIG. 2.

A coil component 100 of this embodiment is a component used for an automobile, various kinds of electrical products, electronic equipments or the like. As shown in FIG. 1, the coil component 100 is provided, for example, with a magnetic core 10 composed of a magnetic material, a coil 1, and two terminals 3 connected to coil end portions 2 of the coil 1.

There is no limitation in particular here for the magnetic material constituting the magnetic core 10, but there can be cited, for example, Mn—Zn-based and Ni—Zn-based ferrites; sendust (Fe—Si—Al alloy) in which there exists a soft magnetic alloy having one kind or more of Fe, Co and Ni as the main component thereof; permalloy (Fe—Ni alloy, Fe—Ni—Mo alloy); Fe—Si alloy; Fe—Co alloy; Fe—P alloy; amorphous metal or carbonyl iron powders; and/or the like. Then, the magnetic core is formed by press-molding granulation powders, which are made by mixing these magnetic materials and various kinds of resin materials starting from a thermosetting resin (for example, epoxy resin or the like), heating and hardening them thereafter.

Also, the magnetic core 10 is formed approximately in a cube shape, and includes a top surface 10*a*, a bottom surface 10*b* facing the top surface 10*a* approximately in parallel and two side surfaces 10*c* which are continuous with the top surface 10*a* and the bottom surface 10*b* approximately perpendicularly and which face each other. Also, the magnetic core 10 includes a front surface 10*d* and a rear surface 10*e* which are continuous approximately perpendicularly with the top surface 10*a* and the bottom surface 10*b* and concurrently, which are continuous approximately perpendicularly with the two side surfaces 10*c* (see FIG. 2). The coil 1 is buried inside this magnetic core 10. Here, "buried" means a state in which the magnetic material constituting the magnetic core 10 surrounds the coil 1 excluding the coil end portion 2 tightly without a gap when seen from any of the up & down, front & back, right & left and inside & outside directions of the coil 1.

The coil 1 is constituted by winding-around a conductive wire of a round wire, a rectangular wire or the like. The two coil end portions 2 of the conductive wire constituting the coil protrude toward the outsides of the magnetic core 10 respectively from the two facing side surfaces 10*c* of the magnetic core 10.

It should be noted at the connecting portion between the flat-shaped terminal 3 and the coil end portion 2 that the insulating coating covering the conductive wire is removed and the conductive wire composed, for example, of a copper material or the like is exposed. Also, the coil end portion 2 in this embodiment is processed into a flat shape by crush-processing the round wire. It should be noted in this embodiment that an example in which the coil end portion 2 is processed into a flat shape was explained, but it is not to be limited by this configuration and it is allowed to employ a configuration in which the crush-process is not carried out and the round wire is maintained as it is. Then, this coil end portion 2 is connected with the terminal 3 on the outside of the magnetic core 10.

The terminal 3 of the present invention is formed approximately in a flat shape. The terminal 3 is bent together with the coil end portion 2 toward the bottom surface 10*b* along the side surface 10*c* of the magnetic core 10. Further, the terminal 3 is bent approximately by 90 degree along a ridge line, so called a corner between the side surface 10*c* and the bottom surface 10*b*.

At that time, the coil end portion 2 is arranged on the back surface of the terminal 3, that is, as shown in FIG. 4, between the terminal 3 and the magnetic core 10. Therefore, the coil end portion 2 is not positioned at the most outer surface of the coil component 100. Thus, the most outer surface of the coil component 100 becomes the surface of the terminal 3, so that regardless of the crush-processing accuracy of the coil end portion 2, it is possible to uniform the outer shape of the coil component 100.

Also, as mentioned later, in a state in which after molding the magnetic core 10 integrally by burying a portion of the terminal 3 and the coil 1 in the inside thereof, the coil end portion 2 and the terminal 3 protrude toward the circumference direction of the magnetic core 10, the coil end portion 2 is arranged on the bending direction side of the terminal 3. For this reason, when bending the terminal 3 toward the direction along the side surface 10*c* of the magnetic core 10, it is possible to make a press-in jig surface-contact with the surface of the terminal 3.

Therefore, it becomes possible to add a uniform force onto the terminal 3 stably toward the same direction. Consequently, it is possible to realize a high bending-process accuracy for the coil end portion 2 and the terminal 3, and it is possible to reduce fluctuation of the external dimensions of the coil component 100.

Also, as shown in FIG. 1, there is provided a cut-out portion 31 at the one end portion in the longitudinal direction in the terminal 3. The cut-out portion 31 is a portion formed by cutting-out the end portion of the terminal 3 into an opened shape. Then, by this cut-out portion 31, there are formed two protrusive terminals 35 on the one side in the longitudinal direction in the terminal 3. The two protrusive terminals 35 are buried into the inside of the magnetic core 10 from the side surface 10*c* of the magnetic core 10.

As shown in FIG. 2, there is arranged a portion of the coil end portion 2 in the inside of this cut-out portion 31. Then, at the cut-out portion 31, the terminal 3 and the coil end portion 2 are bent toward the bottom surface 10*b* along the side surface 10*c* of the magnetic core 10. At that time, the coil end portion 2 at the bending position does not contact with the terminal 3. Thus, on an occasion of the bending, it is possible for the bent portion in the coil end portion 2 to escape depending on the cut-out portion 31 and it becomes possible to carry out a correct bending.

It should be noted in this embodiment that there was explained a shape for the cut-out portion 31 in which one end of the end portion thereof is opened, but it is not to be limited by this configuration. It is enough if the coil end portion 2 is made to non-contact with respect to the terminal 3 at least at the bending position, so that it is allowed, for example, to provide an opening portion at the terminal 3 and to arrange its opening portion in the vicinity of the bending position of the coil end portion 2.

Further, as shown in FIG. 3, at a midway portion in the longitudinal direction in the terminal 3, there is formed an opening portion 37 opened in a rectangular shape. As shown in FIG. 1 and FIG. 4, this opening portion 37 is provided at a place at which the terminal 3 is bent along the corner between the side surface 10*c* and the bottom surface 10*b*.

Thus, it is possible to make the cross-section area of the terminal 3 at the bent place smaller and it is possible to bend the terminal 3 by a smaller force than that of a terminal which is not provided with the opening portion 37. Thus, it becomes a state in which the adjustment of the force to be added can be carried out easily when bending the terminal 3, it is possible to heighten the bending accuracy, and it is possible to bend the terminal 3 accurately along the corner between the side surface 10*c* and the bottom surface 10*b* in the magnetic core 10.

In addition, since the force required for the bending of the terminal 3 becomes small, also the force applied to the corner of the magnetic core 10 when being bent can be made small. Thus, it is possible, when bending the terminal 3, to prevent the corner of the magnetic core 10 from being damaged.

Here, there will be considered a case in which the opening portion 37 is not provided at the terminal 3. In this case, the cross-section area of the terminal 3 at the bent place is large compared with that in case of providing the opening portion 37, so that the necessary force on an occasion of the bending becomes large. Therefore, there is a case in which the terminal 3 is not bent accurately along the corner between the side surface 10*c* and the bottom surface 10*b* and in which a portion of the bending place of the terminal 3 will swell. As a result thereof, there is a fear that the terminal 3 does not become parallel with the bottom surface 10*b* and fluctuation of the external dimensions of the coil components 100 will occur.

On the other hand, it is possible for the coil component 100 of this embodiment to bend the terminal 3 accurately along the corner between the side surface 10*c* and the bottom surface 10*b* owing to a mechanism in which the opening portion 37 is provided. Therefore, it is possible to form a portion of the terminal 3 after being bent to be approximately in parallel with respect to the bottom surface 10*b* and it is possible to improve the external-dimensional accuracy of the coil component 100.

As shown in FIG. 2, the opening portion 37 includes a first edge 37*a*, a second edge 37*b* facing this first edge 37*a* approximately in parallel and two third edges 37*c* with which the first edge 37*a* and the second edge 37*b* are connected. The first edge 37*a* and the second edge 37*b* are formed approximately in parallel with the first edge 3*a* and the second edge 3*b*, which are extending along the longitudinal direction in the terminal 3. Therefore, the distance between the first edge 37*a* and the second edge 37*b* are identical at whichever place thereof.

Therefore, when bending the terminal 3, it is possible to set the length of the opening of the opening portion 37 at the bending place in the terminal 3 always to be approximately equal. Thus, even if the bending place of the terminal 3 deviates slightly, there never occurs a situation in which the opening length of the opening portion 37 changes. More specifically, the cross-section area of the terminal 3 at the bending place always becomes constant, so that it is possible to bend the terminal 3 always with an identical force. As a result thereof, it is possible to heighten the bending accuracy of the terminal 3 furthermore.

It should be noted that the width of the opening portion 37, that is, the distance between the first edge 37*a* and the second edge 37*b* is set to be ⅓ or more of the width (distance between the first edge 3*a* and the second edge 3*b*) of the terminal 3.

Also, as shown in FIG. 3, when manufacturing the coil component 100, it is possible to cut the coil end portion 2 of the coil 1 by inserting a jig or the like into the opening portion 37 provided at the terminal 3. Therefore, when bending the terminal 3 from the side surface 10*c* to the bottom surface 10*b*, there occurs a situation in which only the terminal 3 is bent. Therefore, the force necessary for bending the terminal 3 can be made smaller than that when bending the terminal 3 and the coil end portion 2 all together.

Further, as shown in FIG. 4, for the magnetic core 10, there are provided two grooves of a first groove 4 and a second groove 5. The first groove 4 is provided at the side surface 10*c* and the bottom surface 10*b*. This first groove 4 is continuous from one end of the top surface 10*a* at the side surface 10*c* by extending over the other end of the bottom surface 10*b* and extends approximately up to the center portion of the bottom surface 10*b*.

This first groove 4 is a concave portion which is concave by one step from the most outer surfaces of the side surface 10*c* and the bottom surface 10*b* of the magnetic core 10. The width of the first groove 4 is formed to be wider than the width of the terminal 3. Then, in this first groove 4, there is arranged the bent terminal 3. Thus, the length of the terminal 3 protruding from the side surface 10*c* of the magnetic core 10 can be made shorter and it is possible to achieve miniaturization of the coil component 100. Also, by forming the width of the first groove 4 wider than the width of the terminal 3, it is possible to arrange the terminal 3 within the first groove 4 reliably even if the terminal 3 is distorted, is thermally expanded and so on.

It should be noted that there may be employed a configuration in which by increasing the groove depth of the first groove 4 more than the thickness of the terminal 3, the terminal 3 after being bent does not protrude from the side surface 10*c* and the bottom surface 10*b* of the magnetic core 10 even if there occurs a slight bending error. Thus, it is possible to set the side surface 10*c* and the bottom surface 10*b* themselves of the magnetic core 10 to be the most outer surfaces of the coil component 100, and it is possible to stably provide external dimensions of narrow tolerance.

Also, for the first groove 4 formed at the side surface 10*c* of the magnetic core 10, there is provided a second groove 5. The second groove 5 is provided from the position at which the coil end portion 2 at the side surface 10*c* of the magnetic core 10 protrudes up to the other end of the bottom surface 10*b* at the side surface 10*c*.

As shown in FIG. 2 and FIG. 3, this second groove 5 is a concave portion which is concave further by one step from the stepped surface 4*a* of the first groove 4. The width of the second groove 5 is formed to be wider than the width of the coil end portion 2. Also, the depth of the second groove 5 is formed to be approximately the same size as or a little bit larger than the thickness of the coil end portion 2.

Then, as shown in FIG. 4, the bent coil end portion 2 is housed in this second groove 5. With regard to the coil end portion 2, the crush-process is applied thereto, so that there is a fear that fluctuation occurs in the crush-processing accuracy. However, by housing the coil end portion 2 in the second groove 5 such as seen in the coil component 100 of this embodiment, it is possible to provide the external dimensions stably regardless of the crush-processing accuracy of the coil end portion 2.

1-2. Manufacturing Method of Coil Component

Next, there will be explained a manufacturing method of the coil component 100 having the abovementioned constitution.

First, for example, a conductive wire which is formed by coating the circumference of a copper material with an insulating coating is wound-around by a predetermined number of turns and the coil 1 is formed. Next, the terminals 3 are arranged at the two coil end portions 2 of the coil 1. Then, the crush-process is carried out onto the coil end portions 2 by adding pressure, for example, in a press machine, a jig or the like. Thus, the coil end portions 2 are processed into flat shapes and it becomes easy to connect the coil end portions 2 to the terminals 3 in the succeeding process.

It should be noted that it is allowed to arrange the terminals 3 with respect to the coil 1 in which the crush-process of the coil end portions 2 are carried out beforehand.

Next, the coil 1 and the terminals 3 are arranged inside a die, and the inside of the die is filled with granulation powders composed of a magnetic material and a thermosetting resin, or the like. Then, a powder-compacted body is formed by being pressed. Then, by heating and hardening this powder-compacted body, the magnetic core 10 shown in FIG. 3 is formed. Next, the coil end portions 2 of the coil 1 are cut for predetermined lengths by inserting the jig into the opening portions 37 provided at the terminals 3.

Then, a rustproofing treatment is applied to the surface of the magnetic core 10 and concurrently, the terminal 3 and the coil end portion 2 are bonded, for example, by soldering, welding or the like. Finally, by pressing the terminals 3 toward the bottom surface 10*b* of the magnetic core 10 by using a jig or the like, the terminals 3 and the coil end portions 2 are bent along the side surfaces of the magnetic core 10. Thus, as shown in FIG. 4, the coil end portions 2 are housed in the second grooves 5 provided on the side surfaces 10*c* of the magnetic core 10. Further, as shown in FIG. 3, portions of the terminals 3 are arranged in the first grooves 4 provided at the side surfaces 10*c* of the magnetic core 10.

It should be noted that the cut-out portions 31 are provided at the end portions of the terminals 3 on the sides which are buried in the magnetic core 10 and the coil end portions 2 are arranged therein. Consequently, the coil end portions 2 at the bending positions do not contact with the terminals 3. Thus, on an occasion of the bending, it is possible for the above-mentioned protrusion-length portions of the coil end portions 2 to escape depending on the cut-out portions 31 and it becomes possible to carry out a correct bending.

Next, the terminals 3 are further bent along the bottom surface of the magnetic core 10 at the corners between the side surfaces and the bottom surface, which are so called ridge lines, of the magnetic core 10. Thus, portions of the terminals 3 are arranged in the first grooves 4 provided on the bottom surface 10*b* of the magnetic core 10.

Also, for the bending places at the corners between the side surfaces 10*c* and the bottom surface 10*b* in the terminals 3, there are provided rectangular shaped opening portions 37. Therefore, it is possible to make the cross-section areas of the bending places of the terminals 3 small and it is possible to make the force necessary for the bending of the terminals 3 small. Thus, it becomes easy to carry out the adjustment of the force to be added when bending the terminals 3 and it is possible to heighten the bending accuracy. As a result thereof, it is possible to bend the terminals 3 approximately by 90 degrees accurately along the corners between the side surfaces 10*c* and the bottom surface 10*b* in the magnetic core 10.

Further, the coil end portions 2 are cut at the opening portions 37, so that there occurs a situation in which only the terminals 3 are to be bent when bending the terminals 3 from the side surfaces 10*c* toward the bottom surface 10*b*. Therefore, it is possible to make the force necessary for the bending of the terminals 3 smaller than that at the time of bending the terminals 3 and the coil end portions 2 all together.

Thus, the coil component 100 is completed as shown in FIG. 1 and the shipment thereof will be carried out after employing an inspection process.

It should be noted for the manufacturing method that the method is not limited by this one example and, for example, it is also possible to change the sequence appropriately such that the crush-process of the coil end portion is to be carried out in the process of forming the coil 1, or the like.

In this exemplified embodiment, as shown also in FIG. 3, the coil end portions 2 are arranged on the back sides of the terminals 3, that is, between the terminals 3 and the magnetic core 10. Therefore, when bending the terminals 3, it is possible to make the jig surface-contact with the surfaces of the terminals 3 reliably, so that it is possible to press-in the terminals 3 by adding the force uniformly and also stably in the same direction.

Consequently, the terminals 3 can be bent accurately, so that it is possible to reduce the fluctuation of the external dimensions.

Also, on the side surfaces of the magnetic core 10, there are formed first grooves 4, so that it is possible to house the bent coil end portions 2 in the insides of the first grooves 4. Thus, regardless of the crush-processing accuracy of the coil end portions 2, it is possible to heighten the external-dimensional accuracy and it is possible to achieve also the miniaturization of the product.

2. Second Exemplified Embodiment

Next, there will be explained a coil component relating to a second exemplified embodiment of the present invention with reference to FIG. 5 and FIG. 6.

Figure 5:
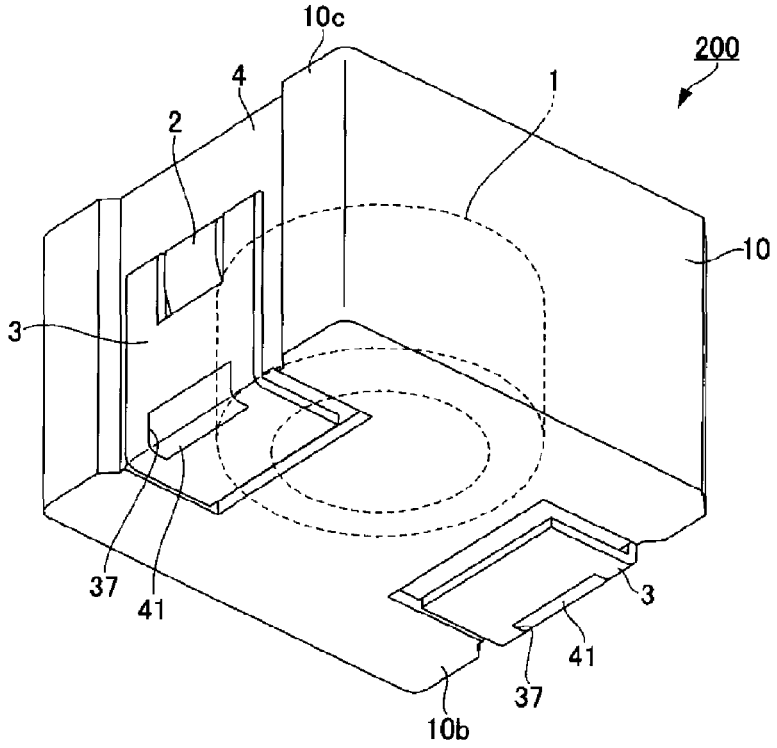
FIG. 5 is a perspective view of a coil component relating to a second exemplified embodiment of the present invention.
Figure 6:
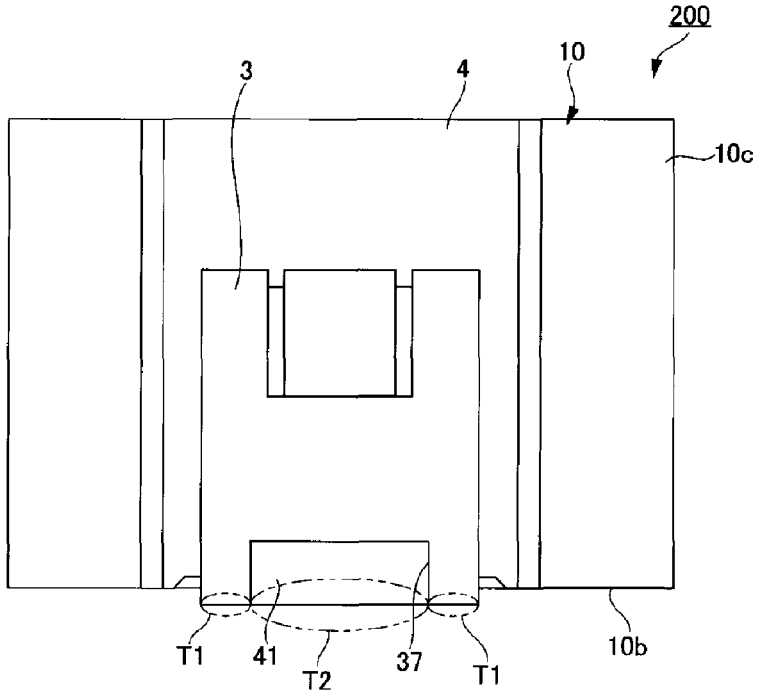
FIG. 6 is a side view of the coil component relating to the second exemplified embodiment of the present invention.

FIG. 5 is a perspective view showing a constitution of a coil component 200 relating to the second exemplified embodiment and FIG. 6 is a side view showing the coil component. It should be noted that the same reference numerals are applied for the portions corresponding to those in the first exemplified embodiment (FIGS. 1 to 4), in which repetitive explanations thereof are to be avoided.

As shown in FIG. 5 and FIG. 6, the coil component 200 relating to the second exemplified embodiment is a component in which the opening portions 37 provided at the terminals 3 are filled with filling members 41. These filling members 41 are members with which the opening portions 37 are filled after bending the terminals 3 from the side surfaces 10*c* to the bottom surface 10*b* of the magnetic core 10.

For the filling member 41, there is used, for example, a solder having a higher melting point than the melting point of the solder which is used when mounting the coil component 200 on the substrate board or the like.

Also, for the filling member 41, the member is not to be limited by the solder and it is allowed to apply another filling member having electrical conductivity and, for example, it is allowed to fix approximately L-shaped members having shapes corresponding to the opening portions 37 of the terminals 3 in the insides of the opening portions 37 by using an electrically-conductive adhesive agent or the like.

Other constitutions are similar to those of the coil component 100 relating to the abovementioned first exemplified embodiment, so that the explanation thereof will be omitted. Depending also on the coil component 200 having such a constitution, it is possible to obtain an operation and an effect similar to those of the coil component 100 relating to the abovementioned first exemplified embodiment.

It should be noted according to the coil component 200 relating to this second exemplified embodiment that, as shown in FIG. 6, when mounting the coil component 200 on the substrate board or the like, it is possible, at the time of the mounting onto the substrate board, to form solder fillets not only on regions T1 at both the ends of the opening portions 37 in the terminals 3 but also on regions T2 including the filling members 41. Thus, the area in which the solder fillets are formed increases compared with that of the coil component 100 relating to the first exemplified embodiment, so that it is possible to heighten the bonding strength between the coil component 200 and the substrate board.

3. Third Exemplified Embodiment

Next, there will be explained a coil component relating to a third exemplified embodiment of the present invention with reference to FIG. 7 and FIG. 8.

Figure 7:
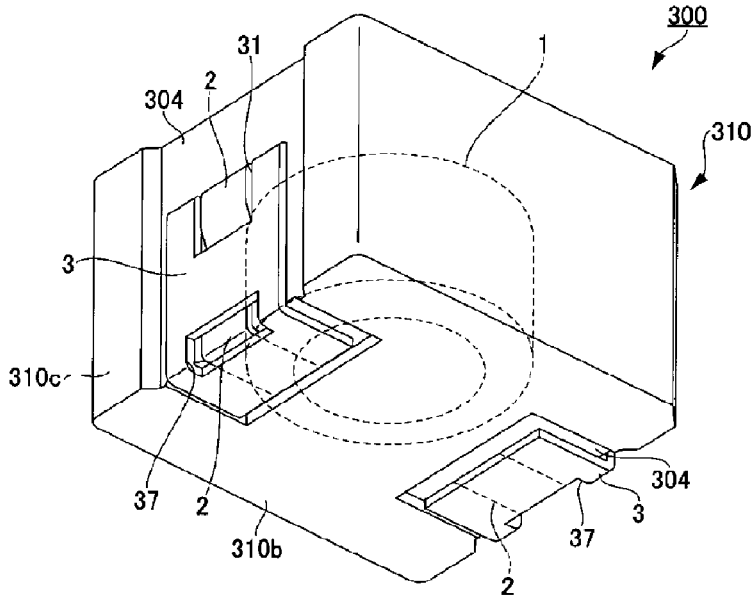
FIG. 7 is a perspective view of a coil component relating to a third exemplified embodiment of the present invention.
Figure 8:
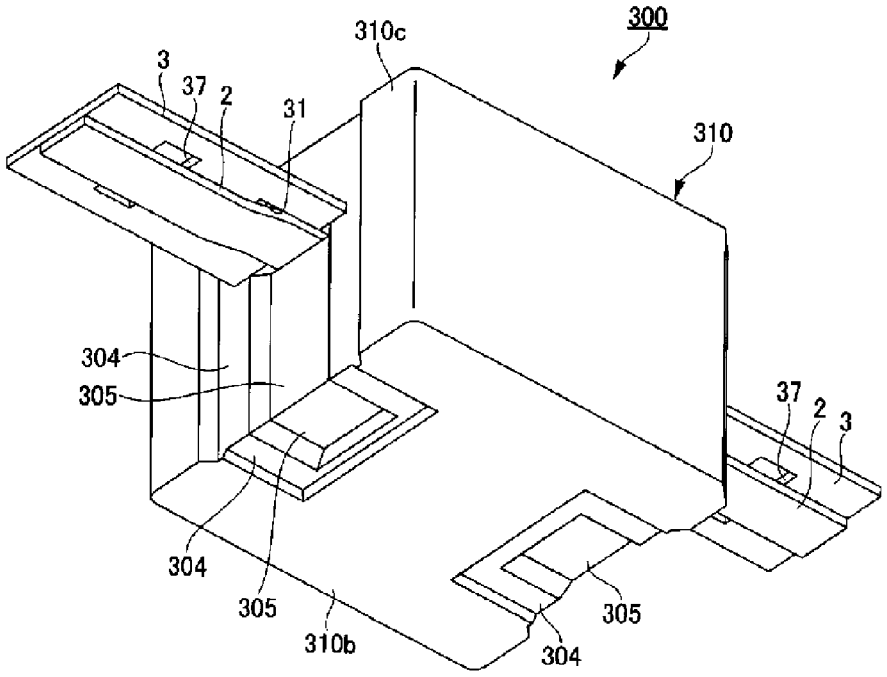
FIG. 8 is a perspective view showing a state before bending a flat-shaped terminal in the coil component relating to the third exemplified embodiment of the present invention.

FIG. 7 is a perspective view showing a coil component 300 relating to the third exemplified embodiment and FIG. 8 is a perspective view showing a state before bending the terminals 3 in the coil component 300.

The aspects, in which the coil component 300 relating to this third exemplified embodiment is different from the coil component 100 relating to the first exemplified embodiment, lie in the positions at which the coil end portions of the coil are cut and the shape of the magnetic core. Therefore, here, there will be explained the coil end portions and the magnetic core, in which the same reference numerals are applied to the portions common to those of the coil component 100 and repetitive explanations thereof will be omitted.

As shown in FIG. 7, the coil component 300 is provided with a coil 1 in which a conductive wire such as, for example, a round wire, a rectangular wire or the like is wound-around, a magnetic core 10 which is formed by a magnetic material and which has the coil 1 buried in the inside thereof, and terminals 3 connected to coil end portions 2 of the coil 1.

The terminals 3 have constitutions identical to those of the terminals 3 of the coil component 100 relating to the first exemplified embodiment and are bent toward the bottom surface 310*b* along the side surfaces 310*c* of the magnetic core 310. Then, the terminals 3 are bent from the side surfaces 310*c* to the bottom surface 310*b* along the corners between the side surfaces 310*c* and the bottom surface 310*b*.

As shown in FIG. 8, the coil end portions 2 of the coil 1 are cut at the end portions on the sides opposite to the cut-out portions 31 in the terminals 3 without being cut at the opening portions 37 of the terminals 3. Then, as shown in FIG. 7, the coil end portions 2 are bent along the side surfaces 310*c* of the magnetic core 310 together with the terminals 3 and further, those are bent also the corners between the side surfaces 310*c* and the bottom surface 310*b* of the magnetic core 310.

Also, as shown in FIG. 8, for the magnetic core 310, there are formed first grooves 304 and second grooves 305 similarly as those of the magnetic core 10 relating to the first exemplified embodiment.

In the coil component 300 relating to this third exemplified embodiment, the coil end portions 2 extend up to the bottom surface 310*b* together with the terminals 3. Therefore, after bending the coil end portions 2, there occurs a situation in which widths as much as the thicknesses of the coil end portions 2 protrude from the bottom surface 310*b* of the magnetic core 310. Consequently, in this third exemplified embodiment, as shown in FIG. 8, the second grooves 305 are provided by being interlinked up to midway portions of the bottom surface 310*b* from the side surfaces 310*c*.

Thus, it becomes possible for the coil end portions 2 which are bent at the corners between the side surfaces 310*c* and the bottom surface 310*b* of the magnetic core 310 to be housed inside the second grooves 305 linked toward the bottom surface 310*b* of the magnetic core 310. Therefore, even in a case in which the coil end portions 2 are not cut at the opening portions 37 of the terminals 3, it is possible to achieve miniaturization of the coil component.

Other constitutions are similar to those of the coil component 100 relating to the abovementioned first exemplified embodiment, so that the explanation thereof will be omitted. Depending also on the coil component 300 having such a constitution, it is possible to obtain an operation and an effect similar to those of the coil component 100 relating to the abovementioned first exemplified embodiment.

4. Fourth Exemplified Embodiment

Next, there will be explained a coil component relating to a fourth exemplified embodiment of the present invention with reference to FIG. 9.

Figure 9:
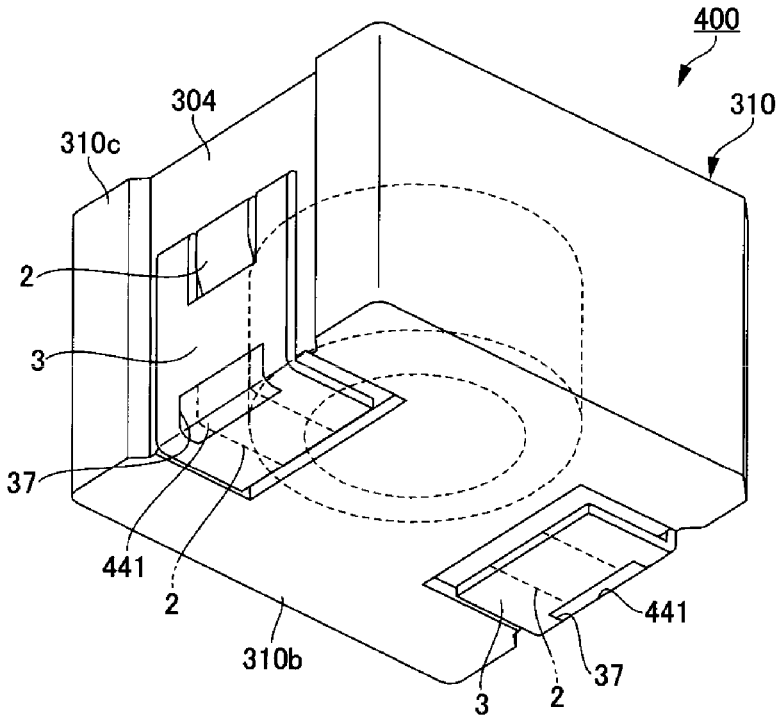
FIG. 9 is a perspective view of a coil component relating to a fourth exemplified embodiment of the present invention.

FIG. 9 is a perspective view of a coil component 400 relating to the fourth exemplified embodiment. It should be noted that the same reference numerals are applied for the portions corresponding to those in the third exemplified embodiment (FIGS. 7 and 8), in which repetitive explanations thereof are to be avoided.

As shown in FIG. 9, the coil component 400 relating to this fourth exemplified embodiment is a coil component in which the opening portions 37 of the terminals 3 in the coil component 300 relating to the third exemplified embodiment are filled with filling members 441.

Other constitutions are similar to those of the coil component 300 relating to the abovementioned third exemplified embodiment, so that the explanation thereof will be omitted. Depending also on the coil component 400 having such a constitution, it is possible to obtain an operation and an effect similar to those of the coil component 100 relating to the abovementioned first exemplified embodiment.

Also, according to the coil component 400 relating to this fourth exemplified embodiment, it is possible to obtain an effect similar to that of the coil component 200 relating to the second exemplified embodiment. More specifically, when mounting the coil component 400 on the substrate board or the like, it is possible, at the time of the mounting onto the substrate board, to form the solder fillets not only in the regions of both the ends of the opening portions 37 in the terminals 3 but also in the regions including the filling members 441, and it is possible to heighten the bonding strength between the coil component 400 and the substrate board.

As described above, there were explained coil components of exemplified embodiments according to the present invention. It is needless to say that the present invention should not be obsessed with the exemplified embodiments described above and there should be included various kinds of embodiments which are further conceivable within the scope without departing from the gist of the present invention described in the claims.

5. Fifth Exemplified Embodiment

Next, there will be explained a coil component relating to a fifth exemplified embodiment of the present invention with reference to FIGS. 10 and 11.

Figure 10:
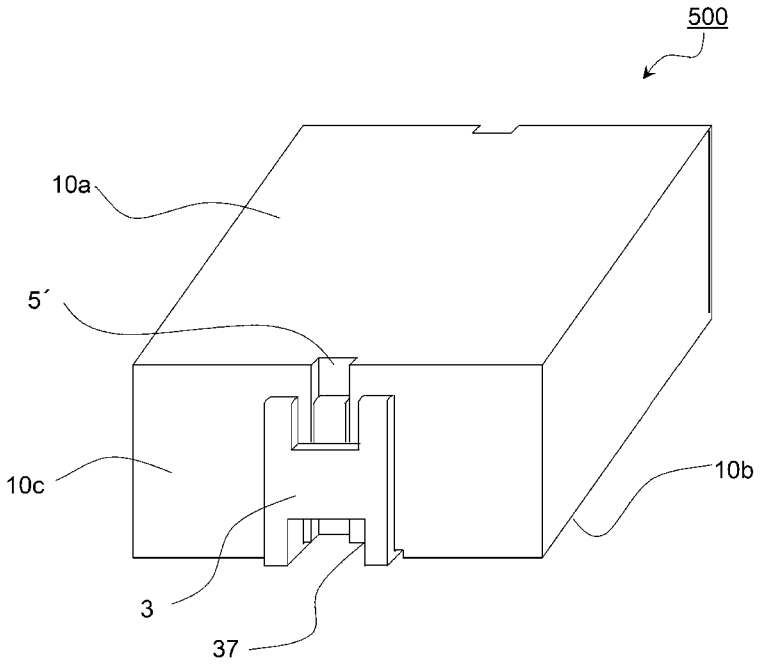
FIG. 10 is a perspective view of a coil component relating to a fifth exemplified embodiment of the present invention.
Figure 11:
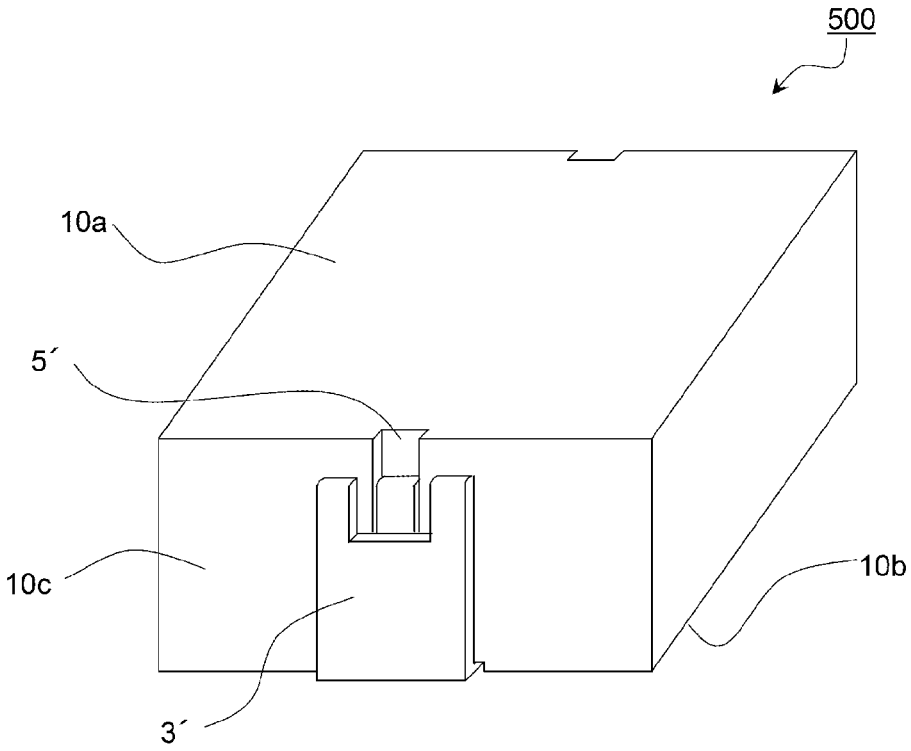
FIG. 11 is a perspective view of another coil component relating to the fifth exemplified embodiment of the present invention.

FIG. 10 is a perspective view of a coil component 500 relating to the fifth exemplified embodiment. It should be noted that the same reference numerals are applied for the portions corresponding to those in the first exemplified embodiment, in which repetitive explanations thereof are to be avoided.

As shown in FIG. 10, compared with the first embodiment, the first grooves 4 do not exist on the side surfaces 10*c* which are attached with the flat-shaped terminals 3. Also, at the side surfaces 10*c*, there are formed second grooves 5' which extend from the top surface 10*a* up to the bottom surface 10*b* of the magnetic core 10. In other words, the side surfaces 10*c* are formed in approximately flat plane-surface shapes except the second grooves 5'.

According to this structure, it is possible to design the coil component 500 to have a low-height profile furthermore. More specifically, along with the progress of the low-height profile, for example, it becomes a situation in which for the magnetic body at the upper portion of the place at which the coil end portions 2 shown in FIG. 4 are pulled out from the magnetic core 10, a dropout will occur easily by the stress when bending the coil end portion 2 and the terminal 3. In order to improve the problem described above, by designing the second grooves 5 to cross the side surfaces 10*c* from upward to downward, it is possible to make a situation in which the yield of the low-height products can be heightened, because even if the coil end portions 2 are bent, it becomes a state in which it is difficult for the stress occurred at that time to be exerted to the magnetic core 10 directly.

It should be noted that the side surfaces 10*c* become approximately flat plane surfaces except the second grooves 5', so that a die used for a press machine for processing that component will become simpler in structure and it is possible to expect an effect of controlling the manufacturing cost to be low.

Further, the coil component is designed to have a lower-height profile, so that it becomes a situation in which there is no room for the terminal 3 to be provided with the opening portion 37. Therefore, for example, as shown in FIG. 11, it is possible for the coil component 500 to use flat shaped terminals 3' in which the opening portions 37 perforated are not provided. In this case, also the troublesome forming-process of the opening portions 37 and also the process of forming the filling members 41 become unnecessary, so that there can be obtained a very profitable advantage when seeing seen from the aspect of the production efficiency and the cost.

Further, as shown in the first or the second embodiment, the coil end portion 2 is cut at the side surface 10*c* and is placed between the side surface 10*c* and the terminal 3'. Also, the coil end portion 2 can be cut at the bottom surface 10*b* and can be placed between the bottom surface 10*b* and the terminal 3', as shown in the third or the fourth embodiment.

At least, this invention includes the following technical thoughts. That is, first, this invention is about a coil component comprising: a magnetic core which is formed by a magnetic material and which has a top surface, a bottom surface facing the top surface and a side surface continuous approximately perpendicularly to the top surface and the bottom surface; a coil which is buried inside the magnetic core and whose end portion protrudes from the side surface of the magnetic core; a flat-shaped terminal which protrudes from the side surface of the magnetic core, is bent toward the bottom surface of the magnetic core and is connected with the end portion of the coil, wherein there is formed an opening portion in the flat-shaped terminal at a position corresponding to the place where the flat-shaped terminal is bent from the side surface to the bottom surface of the magnetic core.

Second, one end of the end portion of the coil is cut at the opening portion of the flat-shaped terminal.

Third, a filling member is to be filled at the opening portion of the flat-shaped terminal after bending the flat-shaped terminal.

Fourth, for the filling member, there is used a solder having a melting point higher than the melting point of the solder which is used when mounting the coil component.

Fifth, the opening portion of the flat-shaped terminal is formed to have a rectangular shape.

Sixth, the opening portion has a width of ⅓ or more of that of the flat-shaped terminal.

Seventh, this invention is about another coil component comprising: a magnetic core which is formed by a magnetic material and which has a top surface, a bottom surface facing the top surface and a side surface continuous approximately perpendicularly to the top surface and the bottom surface; a coil which is buried inside the magnetic core and whose end portion protrudes from the side surface of the magnetic core; a flat-shaped terminal which protrudes from the side surface of the magnetic core, is bent toward the bottom surface of the magnetic core and is connected with the end portion of the coil, wherein there is formed a first groove on the side surface, which has a little wider width than that of the end portion of coil and extends from the top surface to the bottom surface.

Eighth, the side surface is formed in an approximately flat plane-surface shape except the second groove.

Ninth, the terminal is in a solid flat-plane shape.

Tenth, there is formed a second groove on the side surface, which has a little wider width than that of the end portion of coil and is vertically connected with the first groove.

Eleventh, the second groove extends from the side surface to midway of the bottom surface.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A coil component comprising:

a magnetic core which is formed by a magnetic material and which has a top surface, a bottom surface facing the top surface and a side surface continuous perpendicularly to the top surface and the bottom surface;

a coil which has a coil main body and a coil terminal extending from the coil main body, the coil main body being buried inside the magnetic core, the coil terminal protruding from the side surface of the magnetic core;

a flat-shaped terminal which protrudes from the side surface of the magnetic core, which is bent toward the bottom surface of the magnetic core and which is connected with the coil terminal;

an opening portion which is formed in the flat-shaped terminal at a position where the flat-shaped terminal is bent from the side surface to the bottom surface of the magnetic core; and a conductive material that completely fills in the open portion.

2. The coil component according to claim 1, wherein one end of the coil terminal is cut at the opening portion of the flat-shaped terminal.

3. The coil component according to claim 1, wherein a melting point of the conductive material is higher than a melting point of a solder which is used when mounting the coil component to a board.

4. The coil component according to claim 1, wherein the opening portion of the flat-shaped terminal is in a rectangular shape.

5. The coil component according to claim 4, wherein the opening portion has a width of ⅓ or more of a width of the flat-shaped terminal.

6. The coil component according to claim 3, wherein the conductive material is a high melting point solder.

7. The coil component according to claim 3, wherein the solder is formed on the flat-shaped terminal that is located at both sides of the opening portion.

* * * * *